US011208799B2

(12) United States Patent
El-Taher

(10) Patent No.: US 11,208,799 B2
(45) Date of Patent: Dec. 28, 2021

(54) WATERLESS URINAL

(71) Applicant: Todd El-Taher, Silver Spring, MD (US)

(72) Inventor: Todd El-Taher, Silver Spring, MD (US)

( * ) Notice: Subject to any disclaimer, the term of this patent is extended or adjusted under 35 U.S.C. 154(b) by 123 days.

(21) Appl. No.: 16/600,462

(22) Filed: Oct. 12, 2019

(65) Prior Publication Data

US 2021/0108405 A1 Apr. 15, 2021

(51) Int. Cl.
*E03D 13/00* (2006.01)
*E03C 1/28* (2006.01)

(52) U.S. Cl.
CPC ..... *E03D 13/007* (2013.01); *E03C 1/281* (2013.01)

(58) Field of Classification Search
CPC ..... E03D 13/007; E03D 13/00; E03D 13/002; E03D 13/005; E03C 1/281
USPC ..... 4/477
See application file for complete search history.

(56) References Cited

U.S. PATENT DOCUMENTS 2,646,574 A * 7/1953 Gillespie ..... E03D 9/052 4/306
2007/0151011 A1* 7/2007 Brown ..... E03D 13/00 4/310
2008/0295233 A1* 12/2008 Fima ..... E03C 1/281 4/144.1
2010/0050330 A1* 3/2010 Earlywine ..... E03D 3/10 4/321
2014/0020166 A1* 1/2014 Metcalf ..... E03D 5/10 4/301
2016/0069060 A1* 3/2016 Seki ..... E03D 13/005 4/310
2018/0328016 A1* 11/2018 Villalobos Lopez ..... F16K 15/021

* cited by examiner

*Primary Examiner* — Christine J Skubinna

(57) ABSTRACT

A waterless urinal having a motion sensor that opens the drain valve. This sensor also turns on an internal venting fan that draws air from in front of the P trap, upwardly thru the fan, and downwardly to vent the air down the sewer after the P trap. The whole system can be operated by a solar-powered battery system making it well suited for use in off-grid locations, areas prone to drought or water shortage, mobile homes, rest stops, and stadiums.

7 Claims, 9 Drawing Sheets

WATERLESS URINAL

FIELD OF THE INVENTION

The present invention relates to a waterless urinal with active odor control.

BACKGROUND OF THE INVENTION

The P-trap is a common feature of plumbing fixtures and is essentially a device that maintains a body of water between sewer gases and the exterior of the fixture. Although they have been in use for some time, P-traps can still suffer from a number of disadvantages. For example, in the absence of an evaporation barrier, liquids held within the P-trap will evaporate. Once the water in the P-trap has evaporated, the downstream sewage system can pass odors and gases back through the dry P-trap into the restroom. One type of evaporation barrier includes the use of highly flexible covers that deform readily to permit the passage of water through the fixture. Over time, however, the materials from which these valves are constructed become stiff, which can deform that valve and render it ineffective. Such covers and valves can also protrude, which limits their utility with floor drains.

Another type of no-flush urinal uses a replaceable cartridge that houses a sealant oil in an internal weir arrangement. Urine passes through a physical trap, down through the sealant oil (urine is denser than the sealant oil), up and over a weir, and down into a drain line. These cartridges are supposed to be replaced after 7000 uses and have been shown to save water. Unfortunately, the cost of the cartridges remains a costly maintenance item that requires trained staff to replace. See U.S. Pat. Nos. 5,711,037; 6,053,197; 6,425,411; 6,589,440; and 6,701,541.

U.S. Pat. No. 6,977,005 describes another type of waterless toilet for airplanes that uses an annular air jet coordinates with a suction system to remove liquid and solid waste from the bowl and transport the waste to a holding tank. An adhesion-inhibiting coating over the bowl contact surfaces facilitates removal of waste with the air jet.

It would be advantageous to provide a waterless urinal that has a controlled, active, air venting system to avoid the accumulation of odors.

It would further be beneficial to have a waterless urinal system that would operate independently of a community power grid, such as with batteries connected to a series of one or more solar panels.

SUMMARY OF THE INVENTION

It is an object of the present invention to provide a waterless urinal that has a controlled, active, air venting system to avoid the accumulation of odors.

It is further an object of the invention to supply a waterless urinal system that would operate independently of a community power grid so that multiple units could be deployed in facilities that are not necessarily used continuously or in every season.

In accordance with the above and other objectives of the invention that will become apparent from the description here, a waterless urinal that comprises: (a) a lower bowl having a drain, perforated drain plate, and a drain closure valve assembly, (b) a central section, (c) an upper air plenum housing an odor control system having a fan that is operatively configured to withdraw odors from immediately below the drain closure valve and discharge said odors, (d) a proximity sensor operatively connected to open the drain valve and allow electrical power to flow to the air fan when said sensor detects a user at the urinal, and (e) a source of electrical power that powers the operation of the valve assembly, the air control system, and the proximity sensor; wherein the air control system comprises a fan having (i) a suction side operatively connected below said drain closure valve and (ii) a discharge side operatively connected to a vent line.

The waterless urinal of the present invention represents an environmentally responsible, sanitary waste handling system that conserves both water and power using a urinal device that can be made from recycled plastic waste. With a suitable solar-recharged battery array, one or more urinals can be deployed in a wide variety of locations that do not have access to conventional sewage systems or that are located in areas prone to drought or water shortage. The urinals of the invention can also be deployed in businesses, airports, bus stations, and factories that may have access to conventional sewer and power systems but want to reduce their impact on usage of water and power. In the event that solar power is not practical the urinal(s) can be powered with conventional electrical service via 12V transformer

BRIEF DESCRIPTION OF THE DRAWINGS

FIG. 8 is a detailed view of the drain system for the urinal with the valve cover on.

DETAILED DESCRIPTION

Figure 1:
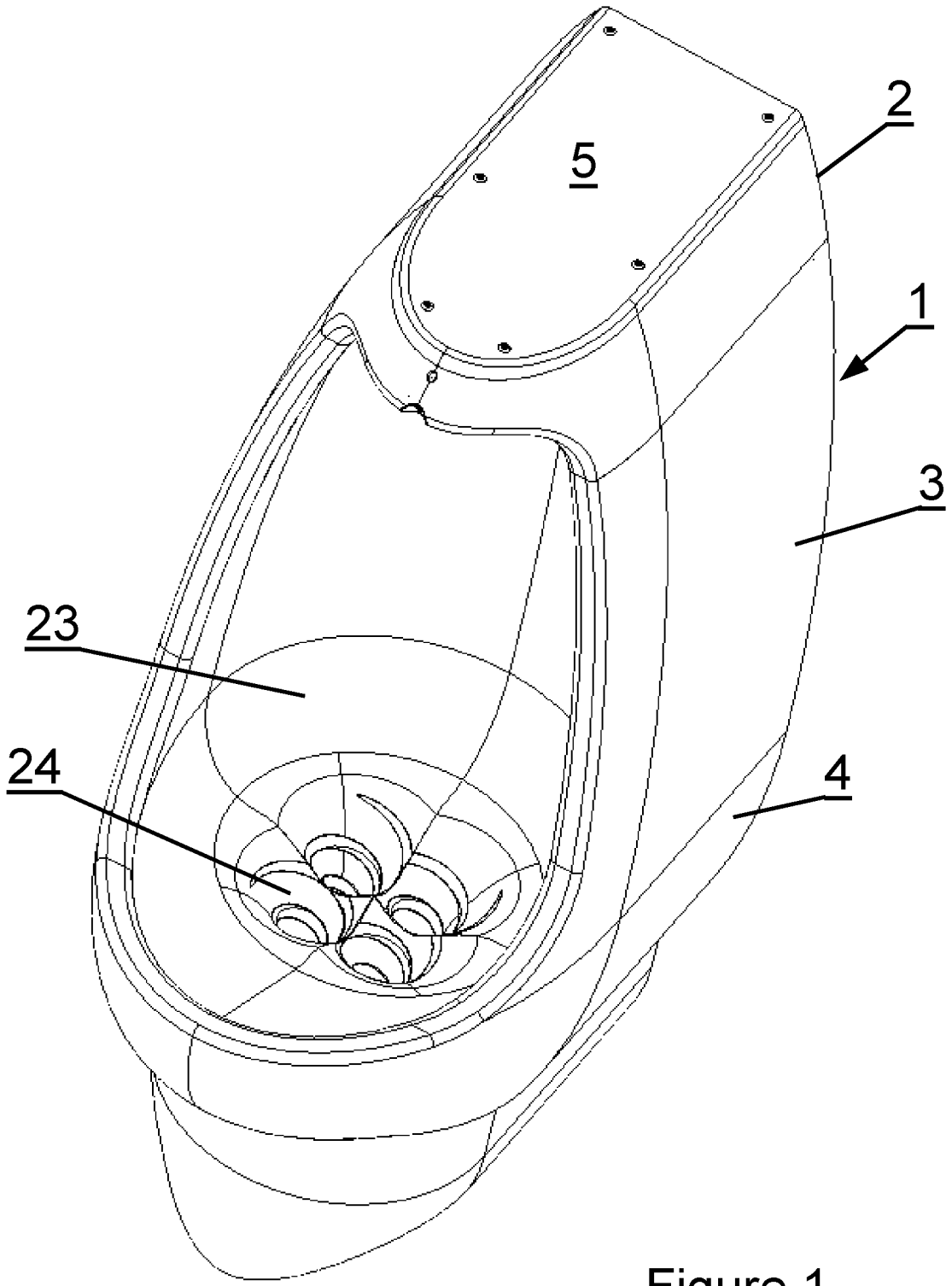
FIG. 1 illustrates an isometric view of a waterless urinal according to the invention.
Figures 2, 3:
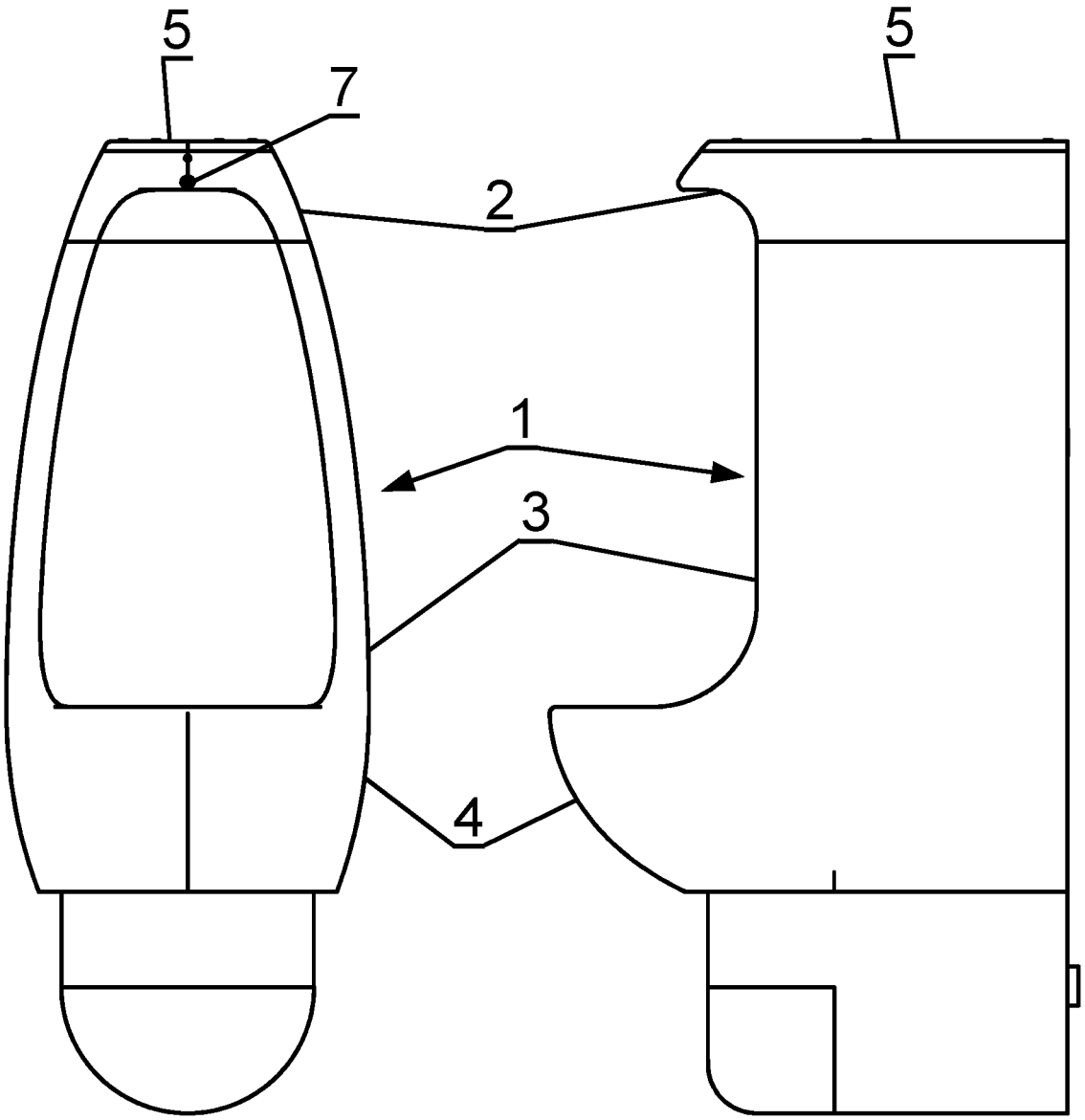
FIG. 2 is a front elevation view of the urinal in FIG. 1.
FIG. 3 is a side view of the urinal in FIG. 1.
Figure 4:
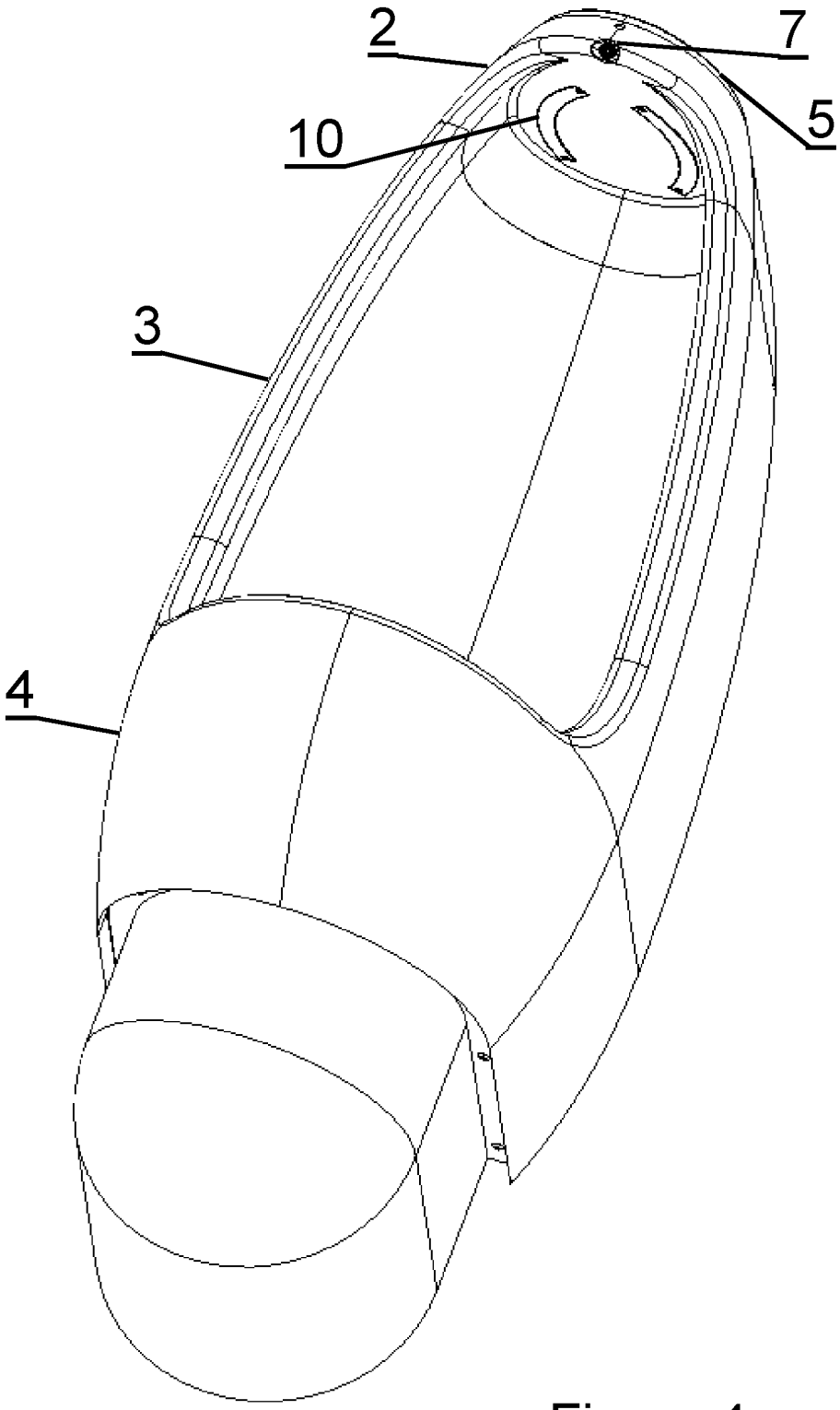
FIG. 4 is a bottom isometric view of the urinal in FIG. 1.

The invention involves a urinal that operates without the need for a source of flushing water and that further includes an air flow management system that controls odors during periods of nonuse. Such devices are well suited for use in off-the-grid locations, regions prone to drought and water shortages, mobile and small homes, stadiums and arena facilities that are not necessarily always in use, or in any location where conservation of water and power are desirable along with sanitary waste disposal.

Generally speaking, the urinal device can be floor-mounted or hung from a wall but a wall-suspended system is preferred. Wall-mounted units are generally preferred as they are lighter, use fewer materials of construction, and provide greater access for installation and assembly. Generally acceptable urinal shapes are of the wall-mounted type are disclosed in U.S. Pat. Nos. 244,381 and 276,621; US publications US2016-0069060; and US2013-0061379. Because the present urinal requires a plumbing connection only for waste liquids and an electrical connection for operation of the discharge drain valve and air handling fan, both of which can be low voltage or 12 v DC units, the wall-mounted urinal of the invention can be hung on the wall with appropriate mounting plates on the rear of the urinal.

The urinal can be made of a variety of materials, e.g., ceramic, porcelain, or molded plastics. Preferably, the urinal is made from joined sections of a molded, recycled, plastic. For example, the preferred embodiment of the invention weighs a mere 22 pounds (10 kg) that is significantly lighter than porcelain or ceramic.

Preferably, the urinal of the invention has at least its internal surfaces coated to repel water and hinder biofouling. See, e.g., U.S. Pat. No. 4,844,986; US2014-0342954; and US2019-0016903. Especially preferred are super hydrophobic coatings that actively repel water-based materials. For adequate adhesion to the surface of a urinal made from recycled plastic, a polyurethane primer may be desirable for durability and to provide the option to add color, or a combination of colors, to the treated surfaces. An especially preferred embodiment has substantially all of its internal and external surfaces treated with a super hydrophobic coating.

The urinal of the present invention comprises: (a) a lower bowl having a drain, perforated drain plate, and a drain closure valve assembly, (b) a central section, (c) an upper air plenum on top of the urinal that houses an odor control system, (d) a proximity sensor, and (e) a source of electrical power that powers the operation of the valve assembly, the air control system, and the proximity sensor.

Lower Bowl

The body of the lower bowl is curved to collect and direct urine to a perforated drain plate having a plurality of openings therein.

One embodiment of a drain valve closure assembly is located immediately below the perforated drain plate has a rotary closure valve made with a rotatable, spring-biased, drain diaphragm having 1-7 openings therein that close the drain plate openings when the drain diaphragm is in a first, closed, position and permits flow thru the drain plate openings when in a second, open, position.

Preferably, the drain closure assembly is in the form of a horizontally rotatable platform disk having a series of angled sealing faces that align with drain openings in the bowl of the urinal. The disk is radially biased to move the sealing faces into a closed position against the drain opening by a torsional spring acting against the disk platform. The drain closure assembly is also centrally secured to a rotational shaft connected by a linkage cable to an actuating pin of a solenoid. When the solenoid activates, the pin is raised thereby applying tension to the linkage cable and rotating the drain assembly around its shaft for so long as the solenoid remains activated. Once power is removed from the solenoid, the drain closure assembly rotates back into a closed position from the biasing effects of the torsional spring.

The drain control diaphragm is spring biased so that the at-rest position is in the closed, first position. Activation of the solenoid by the proximity sensor signal causes the drain diaphragm to rotate so its openings are aligned with the openings in the drain plate and allow urine to pass.

Urine passing through the open drain plate passes downwardly into the upstream end of a sealing trap and then into a conventional sewage discharge line. Such traps are typically referred to by the shape, such as a P-trap, a Q-trap, or an S-trap. The P-trap is the most common so it is conveniently used herein to help describe the invention.

In a preferred embodiment, substantially the entire lower bowl and central sections of the urinal are made of or coated with a superhydrophobic material that actively repels water. One suitable coating is by formed modulated plasma deposition of fluorocarbon. Others are described in US publication numbers 2012-0177881 and 2014-0342954 and U.S. Pat. Nos. 8,338,351; 8,586,693; 8,771,806; 9,067,821; and 9,108,880 the disclosures of which are hereby incorporated by reference.

Odor Control System

Beneath the drain diaphragm of the rotary drain valve assembly and upstream of the curve in the sealing trap is the suction end of a first air passage. The first air passage leads to the suction end of a small fan, preferably a low voltage, 12 v, DC fan that is located in the air plenum at the top of the urinal. Such fans are quite quiet, efficient while moving air at a reasonable rate, and can be activated in coordination with the opening of the drain closure assembly by the same proximity sensor that activates the drain closure solenoid.

Air removed from beneath the drain passes through the fan from its suction side to its discharge side and into a second passage that forms a positive pressure discharge channel for appropriate venting. Although a separate venting line can be used, e.g., a roof vent, the preferred configuration directs the $2^{nd}$ passage to the P-trap for discharge thru the existing sewer line. If desired, a flap vent or shuttered vent can be used in the vent line at or downstream of the fan to control the backflow of any sewer line odors that might try to re-enter the urinal when unused.

If the suction line ($1^{st}$ passage) is not provided in the body of the drain valve assembly, the drain P-trap may include both an upstream connection for the suction line ($1^{st}$ passage) and a post-curve connection for the air vent discharge line ($2^{nd}$ passage).

Air handling is preferably accommodated in an air plenum at the top of the urinal. The fan effectively separates the urinal into a right and left chamber for the $1^{st}$ and $2^{nd}$ passages that allow for the active movement of air flow before and after the P-trap. If desired, the air handling channels can be located within the central or lower sections of the urinal for a more compact form. The odor suction and discharge lines will be correspondingly lowered and realigned.

Proximity Sensor

A preferred activating signal that opens the drain closure valve comes from a noncontact proximity sensor somewhere on the urinal body that senses when a user has approached the urinal within a triggering distance. The term "proximity sensor" includes all sensors that perform detection without physical contact, as opposed to sensors, such as limit switches, that detect objects by physically contacting them. Proximity sensors convert information on the movement or presence of an object into an electrical signal. Such sensors may be generally characterized as inductive (metallic objects), capacitive (metallic and nonmetallic), ultrasonic, photoelectric, and magnetic. The more relevant of these for the present invention are capacitive, ultrasonic, and photoelectric proximity sensors.

Capacitive proximity sensors use the variation of capacitance between the sensor and the object being detected. When the object is at a preset distance from the sensitive side of the sensor, an electronic circuit inside the sensor begins to oscillate. The rise or fall of such oscillation is identified by a threshold circuit that drives an amplifier for the operation of an external load. A screw placed on the backside of the sensor allows the operating distance to be set for longer or shorter distances.

Ultrasonic sensors (also known as transceivers when they both send and receive) generate high frequency sound waves and evaluate the echo received back by the sensor. Sensors calculate the time interval between sending the signal and receiving the echo to determine the distance to an object. Systems typically use a transducer which generates sound waves in the ultrasonic range, above 20,000 hertz, by turning electrical energy into sound. The echo is turned back into electrical energy which can be measured and used to detect proximity. (Sensors based on infrared and microwaves similarly use other types of electromagnetic wave detectors in substantially the same way to detect proximity.) Because ultrasonic sensors use sound rather than light for detection, they work in applications where photoelectric sensors may not. Target color and/or reflectivity don't affect ultrasonic sensors which can operate reliably in high-glare environments.

Photoelectric sensors use light sensitive elements to detect objects and are made up of an emitter (light source) and a receiver.

Preferably, a low voltage (12 v) ultrasonic proximity sensor that is angled in a slightly downward direction to sense foot traffic within the range of a distance of 1-10 feet (1-3 meters) is used in the present invention.

Power System

In a preferred embodiment, the solenoid that controls the drain diaphragm, the air fan, and the proximity sensor all operate using 12 v, low voltage, DC power. Suitable low voltage converters are available to convert the local AC voltage to the desired low voltage, DC current. A preferred supply of such power comes from a bank of one or more deep discharge batteries connected to an array of one or more solar panels whose supply of recharging electricity is controlled by a suitable sized charge controller.

A charge controller is also referred to as a "charge regulator" and is fundamentally a voltage and/or current regulator to keep batteries from overcharging. It also ensures that the power doesn't run backwards to the solar panels overnight and drain the batteries. Most "12 volt" panels put out about 16 to 20 volts, so if there is no regulation the batteries will be damaged from overcharging. The charge controller regulates the voltage and current coming from the solar panels to avoid overcharging or damage to the batteries. It is generally understood that most batteries need around 14 to 14.5 volts to get fully charged.

A solar charge controller is available in two different technologies, PWM and MPPT. How they perform in a system is very different from each other. An MPPT charge controller is more expensive than a PWM charge controller, and it is often worth it to pay the extra money.

A PWM solar charge controller stands for "Pulse Width Modulation". These devices operate by making a connection directly from the solar array to the battery bank. The PWM controller sends out a series of short charging pulses to the battery—a very rapid "on-off" switch. The controller constantly checks the state of the battery to determine how fast to send pulses, and how long (wide) the pulses will be. In a fully charged battery with no load, it may just "tick" every few seconds and send a short pulse to the battery. In a discharged battery, the pulses would be very long and almost continuous, or the controller may go into "full on" mode. The controller checks the state of charge on the battery between pulses and adjusts itself each time. During bulk charging when there is a continuous connection from the array to the battery bank, the array output voltage is 'pulled down' to the battery voltage. As the battery charges, the voltage of the battery rises so the voltage output of the solar panel rises as well thereby using more of the solar power as it charges. It will be noted that when this disclosure refers to a 12V solar panel, that means a panel that is designed to work with a 12V battery. The actual voltage of a 12V solar panel, when connected to a load, is close to 18 Vmp (Volts at maximum power). This is because a higher voltage source is required to charge a battery. If the battery and solar panel both started at the same voltage, the battery would not charge.

An MPPT solar charge controller stands for "Maximum Power Point Tracking". It will measure the Vmp voltage of the panel, and down-converts the incoming panel voltage to the battery voltage. Because power into the charge controller equals power out of the charge controller, when the voltage is dropped to match the battery bank, the current is raised, so you are using more of the available power from the panel. This allows use a higher voltage solar array than battery, like the 60 cell, nominal 20V, grid-tie, solar panels that are more readily available. With a 20V solar panel, you can charge a 12V battery bank, or two in series can charge up to a 24V battery bank, and three in series can charge up to a 48V battery bank. This opens up a whole wide range of solar panels that can be used for off-grid solar systems to power waterless urinals.

For the present invention, most medium to large facilities and solar arrays will preferably use MPPT type charge controllers for the batteries supplying power to the waterless urinal of the present invention. Smaller systems have 1-3 urinals and less than 3 solar panels and 1-5 batteries can likely use a PWM controller.

Example

A preferred device according to the invention is a mold injected plastic urinal of semi conventional shape that is painted the color of choosing and then coated with a super hydrophobic coating.

At the top of the urinal is an air plenum separating a right and left chamber which allow for the active movement of air flow before and after the P-trap. The negative side of the airflow is introduced into the urinal sub-bowl below the drain screen which is in turn discharged on the downstream side of the P trap prior to the common wall connection.

The entire assembly is run with a 12V power supply which is initiated using a motion sensor located at the top of the urinal in a compartment adjacent to the plenum. Upon activation the motion sensor sends power to three assemblies:

1. Lights mounted in the top of the urinal casting light within;
2. A solenoid which opens a rotary four blade valve assembly located directly below the four port drain screen;
3. The fan assembly located in the plenum assembly drawing air through the urinal drain screen at a rate of approximately 60 CFM and discharging behind the P-trap.

The motion sensor deactivates when the patron walks away from the fixture. Upon deactivation the lights go out, fan stops and valve closes.

The rotary valve is connected via spring to a tether within the urinal bowl which facilitates closure of the valve. Parallel to the motion sensor circuit is another 12 v circuit that can activate the rotary valve, drain discharge impeller within the P-trap, and a piezo alarm of approximately 100 db. This circuit has two terminal plates located within the urinal that bridge the ground electrical connection in the presence of water and serve as a malfunction alert and overflow protection.

A preferred embodiment of a urinal according to the invention is shown in the attached figures.

As shown in FIGS. 1-7, waterless urinal 1 has an upper section 2, a middle enclosure section 3, and a lower section 4. Upper section 2 is closed with a cover 5 and encloses control module 6 connected to a source 51 of low voltage (12 v) DC current, proximity sensor 7, air handler system 8 (see also FIGS. 6 and 7), solenoid 9, and LED lights 10 that illuminate the interior of middle section 3. The upper end of middle section 3 includes mounting cleat 11 that is secured to first side wall 12 and second side wall 13 of middle section 3.

Air suction line 14 rises thru middle section 3 and connects to the suction side 15 of air handler system 8. As will be described below, air 16 pulled from urinal drains is passed through up suction line 14, into fan 17, to pressure side 18 of air handler system 8 for passage down discharge line 19 and discharge thru sewage line 20. Air handler system 8 is generally formed by opposing plenum chambers forming suction side 15 and pressure side 18 that are bolted together on either side of fan 17. Fan 17 is preferably a low voltage fan that can be operated by a 12 v DC current upon activation by control module 6. Such fans are virtually silent, operate for many hours, and are available in many sizes to provide a variety of air flow rates.

Control module 6 is preferably in the form of a programmable chip, such as an EPROM, or a simple computer, e.g., Arduino or Raspberry Pi that retains its programming directions even in the absence of a continuously supplied current. The programming instructions include the following upon detection by proximity sensor 7 of an occupant entering the monitored area: (a) turn on LED lights 10, (b) activate solenoid 9 to open valve assembly 22, and (c) activate fan 17.

When proximity sensor 7 no longer detects an occupant within the monitored area, a first timer in control module 6 is started having a duration within the range of about 3 seconds to 20 seconds. All power is discontinued to the system when the timer runs out thereby turning off the LED lights, deactivating solenoid 9 so that control cable 21 retracts and allows spring-biased valve assembly 22 to rotate back into a closed position, and turns off fan 17.

Figure 5:
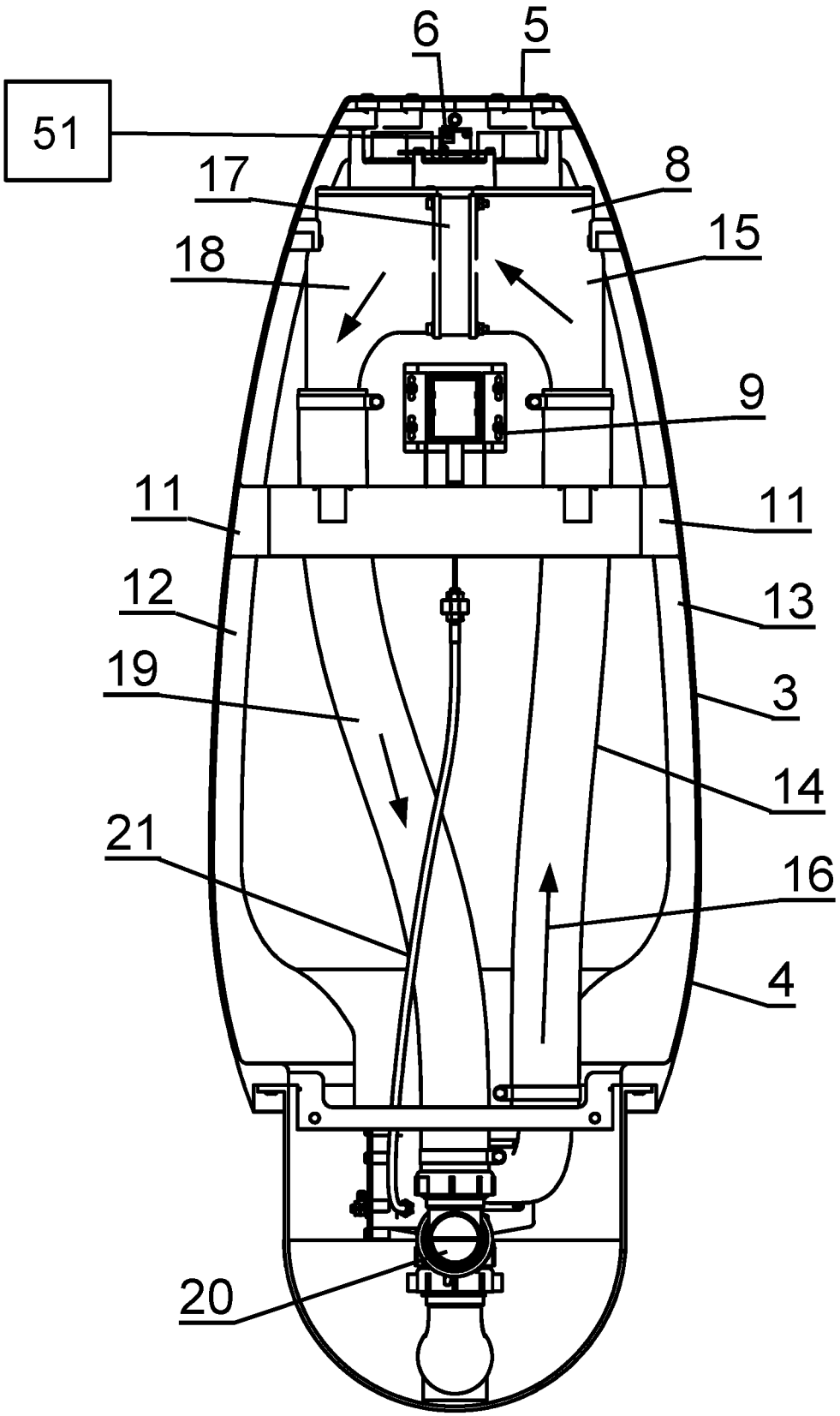
FIG. 5 is a rear view of the urinal in FIG. 1.
Figure 6:
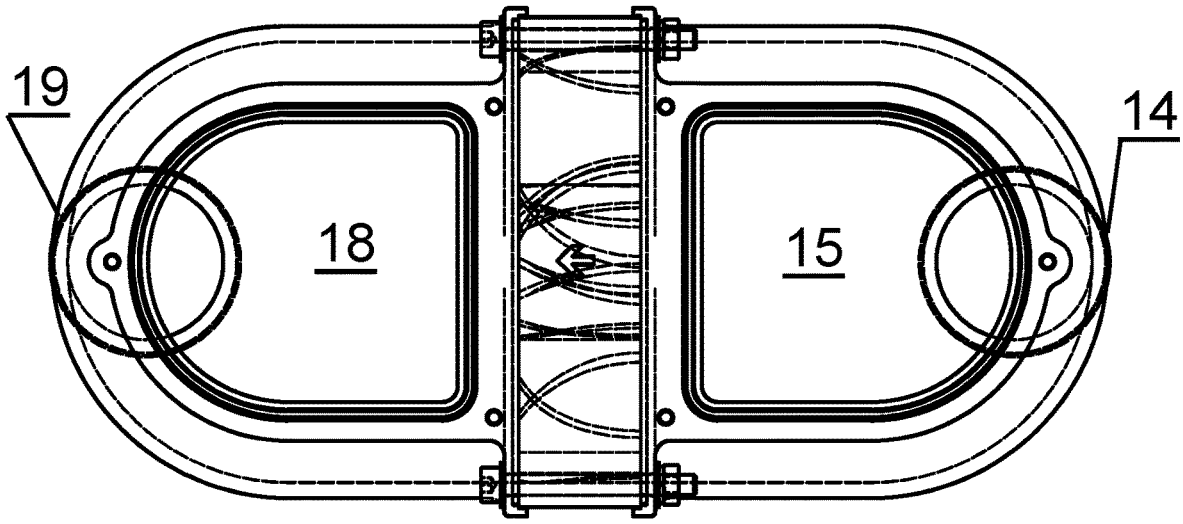
FIG. 6 is a top view of the air handling plenum.
Figure 7:
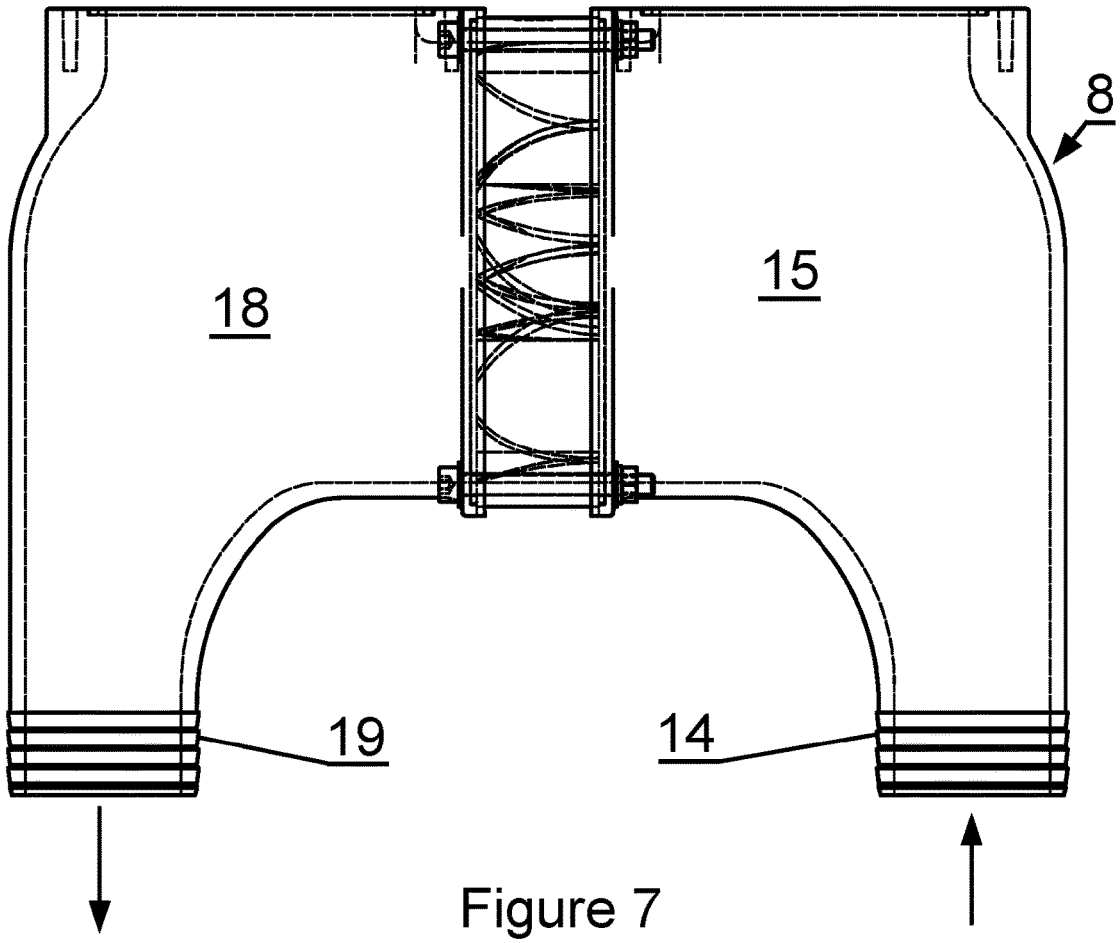
FIG. 7 is a side view of the air handling plenum.

As shown in FIG. 5, solenoid 9 is connected to control cable 21 which acts on discharge valve assembly 22 located below urinal collection area 23 having one or more urinal outlets 24. Any number of outlets 24 are useful although 1-10 outlets 24 are generally desirable with 3-6 being preferred. FIG. 1 illustrates an especially preferred embodiment having four outlets 24.

Collection area 23 generally exhibits a smoothly tapering bowl area that directs flowing liquids to outlets 24 that are themselves smoothly tapering in a downward direction to a discharge end 25 of each outlet 24.

Figure 8:
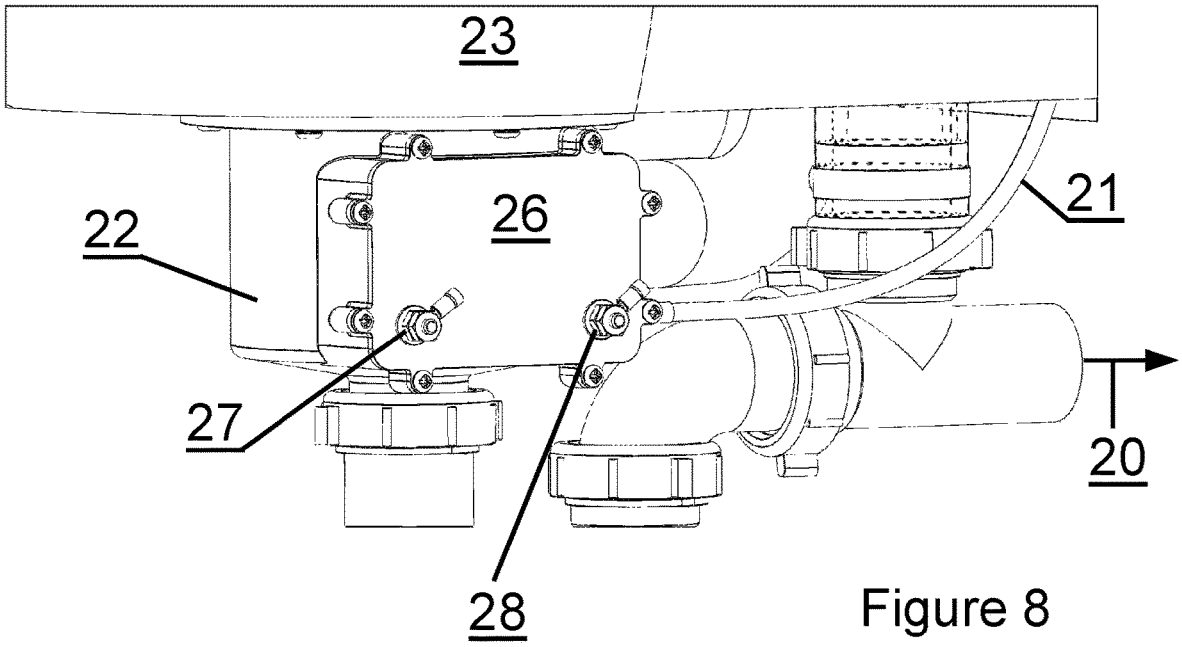

FIGS. 8-12 provide more details views of discharge valve assembly 22. FIG. 8 shows valve assembly 22 with its access cover 26 in place. Control cable 21 is shown as entering from the right side of assembly 22 although that cable can be routed on either side depending on the required rotational direction of the valve to unseal the terminal ends of outlets 24. First and second high liquid level contact electrodes 27, 28 operate as electrodes that activate a forced discharge system 50 (FIG. 12) if liquids begin to accumulate in valve assembly 22 sufficient to bridge the circuit formed by electrodes 27, 28.

Figure 9:
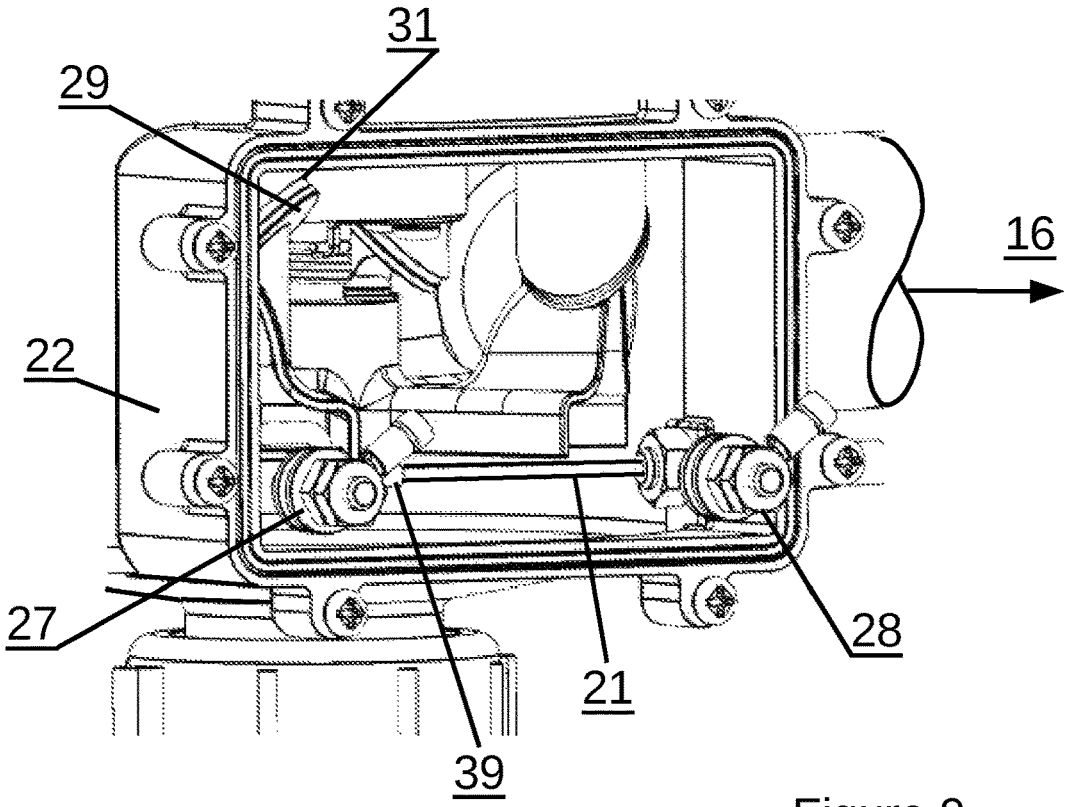
FIG. 9 is a detailed view of the drain system for the urinal with the valve cover off and the rotary valve closing the urinal drains.
Figure 10:
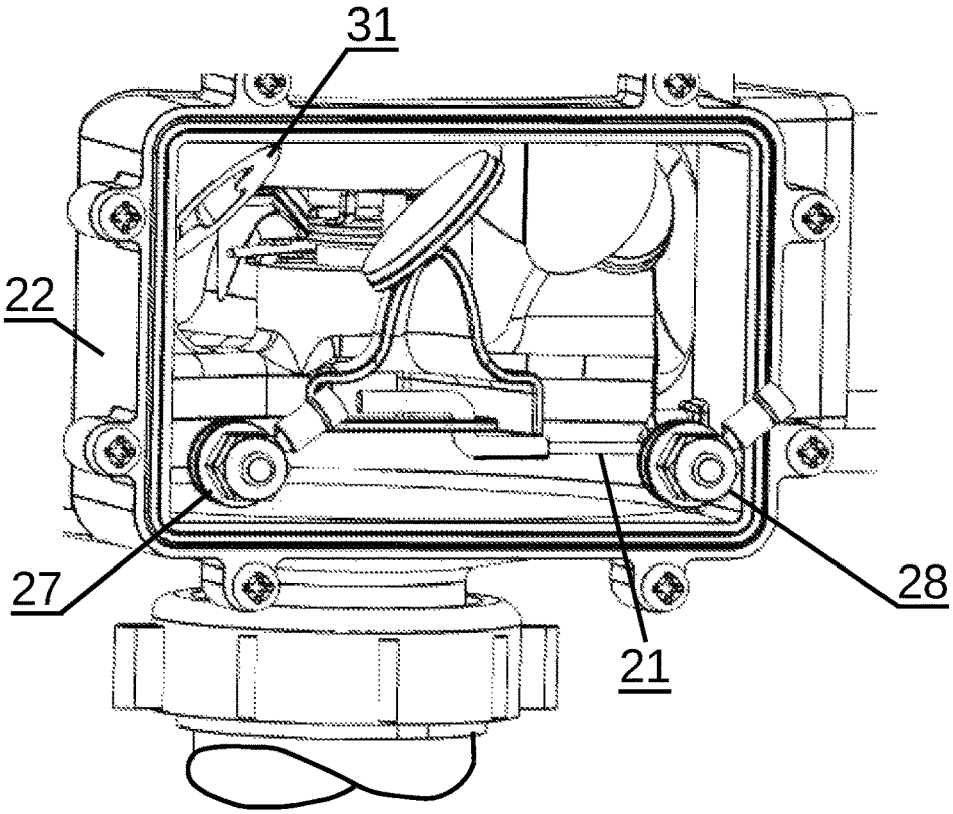
FIG. 10 is a detailed view of the drain system for the urinal with the valve cover off and the rotary valve open to allow flow thru the urinal drains.
Figure 11:
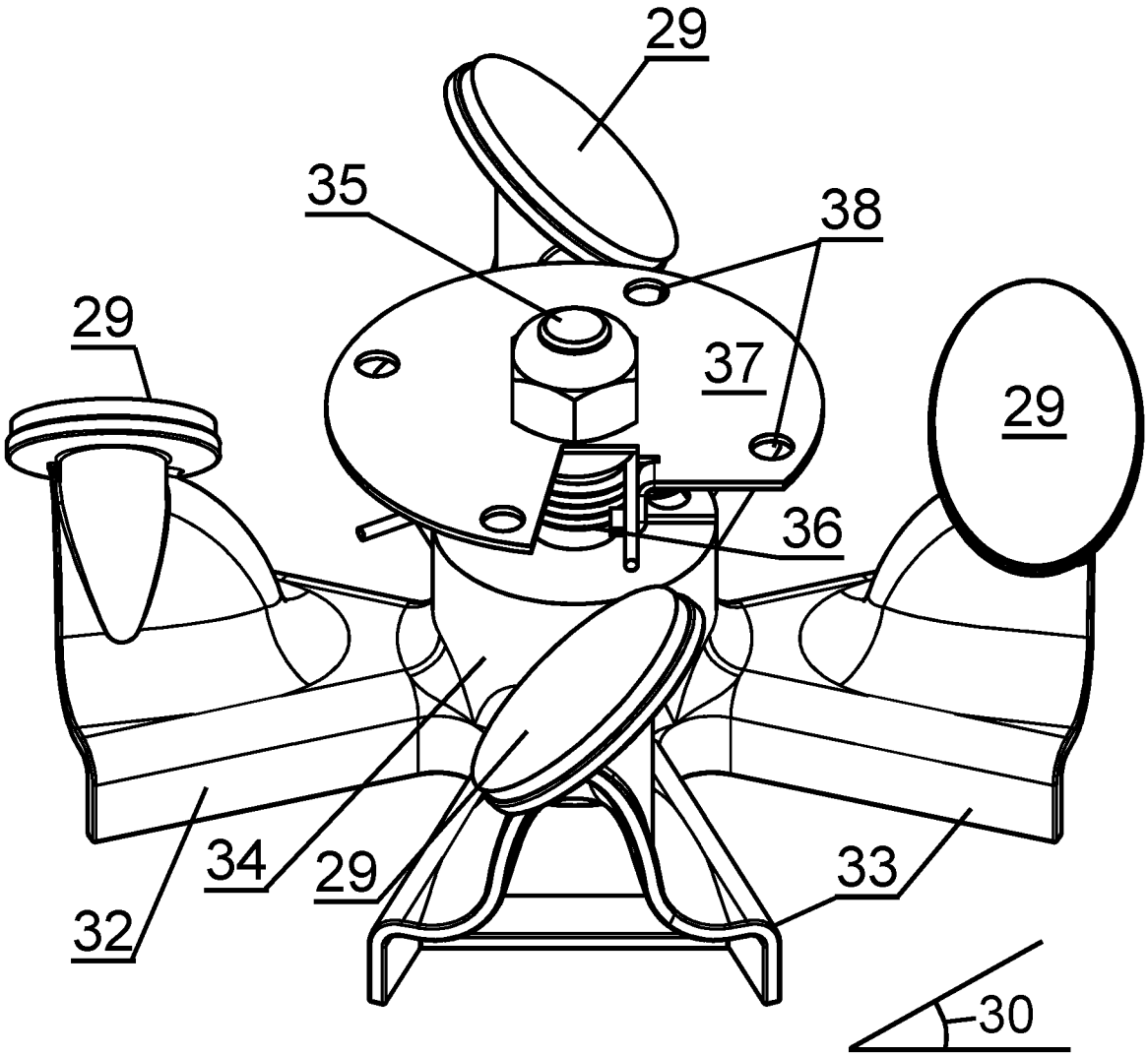
FIG. 11 is a detailed view of the rotary drain valve module.

FIGS. 9 and 10 have cover 26 removed to show the inner workings of valve assembly 22. FIG. 11 is the rotatable valve closure mechanism with sealing faces 29 at an angle 30 relative to a horizontal plane. Angle 30 may be at substantially an angle more than about 10° and less than about 90°. Angle 30 is preferably within the range from about 15° to about 75° and more preferably within a range from about 30°-60°. An especially preferred bias angle 30 is within about 40-50°. The terminal outlet ends 31 of outlets 24 have a corresponding counter bias cut angle to mate with and close each outlet end 31 against ingress or egress of liquids or gases.

Preferably, sealing faces 29 are made from a pliable material that provides a good seal despite repeated cycling and exposure to urine. A preferred material for sealing face 29 is a silicone elastomer.

Sealing faces 29 are preferably disposed in a fixed position and orientation atop elevated platform 32 on top of armatures 33 extending from central valve hub 34. Valve hub 34 is secured onto shaft 35 and rotationally biased by the torsional effects of spring 36 acting on valve spindle perch 37. Spindle perch 37 is mounted on the underside of collection area 23. One or more holes 38 are formed in spindle perch 37 and may be used to engage spring 36 and control end 39 of control cable 21 coming from solenoid 9. When control cable 21 is placed under tension by solenoid 9, arms 33 are rotated away from engagement with terminal outlet ends 31 of each discharge and thereby allow urine to flow to P-trap 40 and discharge to sewage line 20. As this opening is made, air is pulled away from outlet ends 31 by air handler system 8 and routed to sewage line 20 for discharge.

FIG. 9 shows the valve assembly 22 in a closed position with sealing faces 29 engaging terminal outlet ends 31 while FIG. 10 is in an open position with sealing faces 29 rotated away from terminal outlet ends 31.

Figure 12:
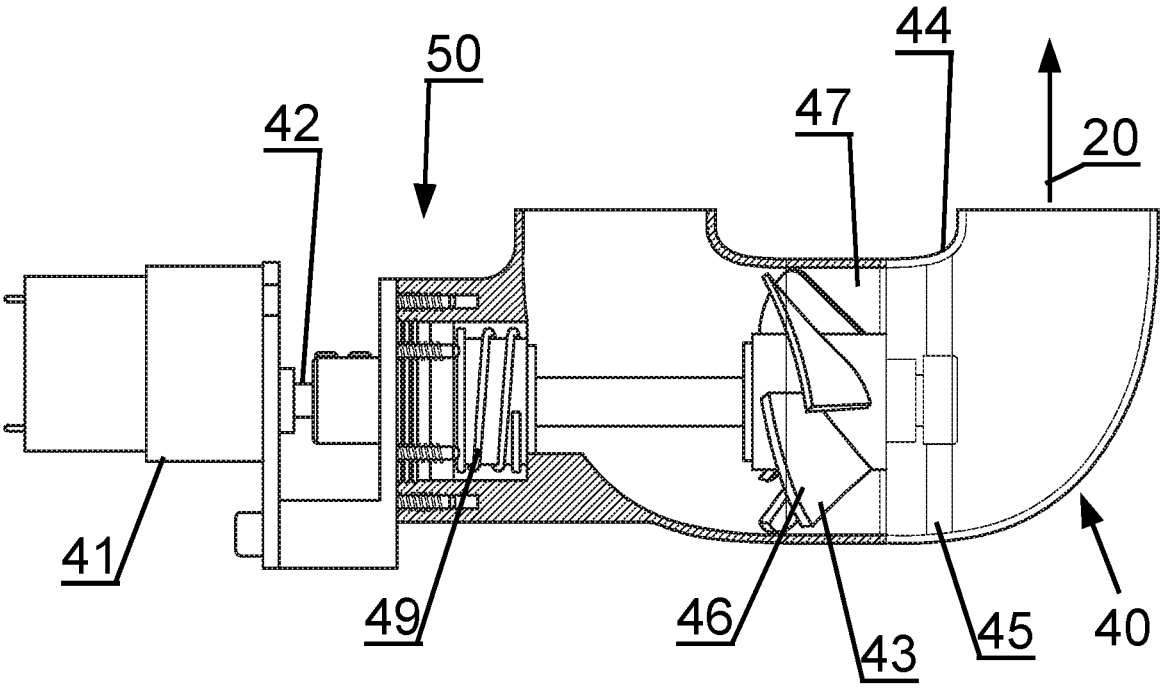
FIG. 12 is a side view of the drain assembly with the cover off and showing a view of the drain-clearing motor.

FIG. 12 is a cutaway view of P-trap 40 to show the internal configuration of blockage-clearing system 50. As noted above, when a liquid level becomes sufficiently high to bridge electrodes 27, 28, the bridged circuit activates motor 41 to turn impeller shaft 42 and pressurizing impeller 43. Impeller shaft 42 extends from motor 41 at a proximal end and is bearingly supported at distal end 44 by support 45 fit within P-trap 40. Impeller 43 is designed with external vanes 46 on a cone-shaped direction from upstream to downstream that channel and compress liquid 47 towards the downstream end 48 of P-trap 40 and out sewage line 20. Compressible spring 49 helps to absorb backflow pressures as the impeller 43 continues to apply pressure to a downstream blockage until that blockage is cleared. When cleared, the liquid level across electrodes 27, 28 opens the high level circuit and disconnects motor 41 from power. If desired, a second timer in control module 6 continues to operate motor 41 for about 5 to 45 seconds to ensure that the line blockage is cleared.

Preferably, control module 6 is also programmed to activate all systems occasionally even if the unit has not been used. A suitable frequency is at least once per month and preferably at a frequency within the range of 2-6 times per month. Operation once a week is a most preferred rate of operation.

It is understood however that the description above is intended to describe preferred embodiments and is not intended to limit the scope of the appended claims.

The invention claimed is:

1. A waterless urinal that comprises:

a. a lower bowl having a drain, at least one discharge drain, and a drain closure valve assembly for each discharge drain, b. a central section, c. an upper air plenum housing an odor control system having a fan that is operatively configured to withdraw odors from immediately below the drain closure valve and discharge said odors, d. a proximity sensor operatively connected to open the drain valve and allow electrical power to flow to the air fan when said sensor detects a user at the urinal, and e. a source of low voltage DC electrical power that powers the operation of the valve assembly, the air control system, and the proximity sensor;

wherein the air control system comprises a fan having (i) a suction side operatively connected below said drain closure valve and (ii) a discharge side operatively connected to a vent line; and wherein said drain closure valve comprises a rotary closure valve.

2. A waterless urinal comprising an upper section (2) and a lower section (4) wherein a. said upper section (2) encloses control module (6) that is connected to a source of low voltage DC current, a proximity sensor (7), an air handler system (8), a solenoid (9), and LED lights (10) that illuminate said middle section (3);

b. said lower section (4) comprises a collection area (23) and a discharge valve assembly (2) that directs captured urine to a discharge sewage line;

wherein said lower section comprises 1-10 discharge outlets for captured urine;

whereby detection of a user within a zone monitored for occupancy by said proximity sensor activates the lights, the air handler system, and opens the discharge valve assembly wherein each discharge outlet exhibits a terminal end that is closed with a sealing face on said discharge valve assembly.

3. A waterless urinal according to claim 2 wherein said discharge valve assembly comprises a spring-biased central valve hub (34) with a plurality of arms (33), each arm (33) having an elevated terminal platform (32) onto which is mounted a sealing face (29) that is angled to mate with and close a discharge outlet.

4. A waterless urinal according to claim 3 wherein said discharge valve assembly further comprises a spindle perch (37) that is mounted to an underside of said collection area (23).

5. A waterless urinal according to claim 4 wherein the solenoid is operably connected to said spindle perch with a control cable whereby activation of said solenoid causes said spindle perch to rotate against torsion effects from a spring.

6. A waterless urinal according to claim 2 wherein said discharge valve assembly further comprises a pair of electrodes that close if contacted by a high liquid level and thereby activate a blockage-clearing system.

7. A waterless urinal according to claim 6 wherein said blockage-clearing system comprises a motor, a shaft, and a pressurizing impeller within a P-trap leading to a sewage discharge line, whereby activation of said blockage-clearing system causes said motor to rotate said shaft and said pressurizing impeller and thereby exert pressure on a downstream blockage until said blockage is cleared.

* * * * *